US006038998A

United States Patent [19]

Platsch

[11] Patent Number: 6,038,998

[45] Date of Patent: Mar. 21, 2000

[54] DEVICE FOR APPLYING POWDER TO SHEETS

[75] Inventor: Hans Platsch, Stuttgart, Germany

[73] Assignee: Heidelberger Druckmaschinen AG, Heidelberg, Germany

[21] Appl. No.: 08/988,259

[22] Filed: Dec. 10, 1997

[30] Foreign Application Priority Data

Dec. 10, 1996 [DE] Germany ..... 196 51 302
Nov. 25, 1997 [DE] Germany ..... 197 51 972

[51] Int. Cl.[7] ..... B05C 19/00

[52] U.S. Cl. ..... 118/46; 118/629; 118/630; 118/308; 271/195; 271/211; 101/424.2; 101/416.1

[58] Field of Search ..... 118/46, 50, 236, 118/629, 630, 308, DIG. 4; 427/471, 475, 180; 239/690, 708; 271/195, 211; 101/424.2, 416.1

[56] References Cited

U.S. PATENT DOCUMENTS

| | | | |
|---|---|---|---|
| 3,556,519 | 1/1971 | Keller . | |
| 4,598,870 | 7/1986 | Schloz . | |
| 5,090,626 | 2/1992 | Platsch . | |
| 5,443,005 | 8/1995 | Platsch . | |
| 5,447,565 | 9/1995 | Song et al. . | |
| 5,535,676 | 7/1996 | Buschulte et al. | 101/424.2 |
| 5,634,401 | 6/1997 | Weaver | 101/416.1 |
| 5,746,131 | 5/1998 | Henn et al. | 101/424.2 |
| 5,797,326 | 8/1998 | Buschulte et al. . | |
| 5,868,386 | 2/1999 | Stiel et al. | 271/195 |

FOREIGN PATENT DOCUMENTS

| | | |
|---|---|---|
| 0 074 045 A1 | 3/1983 | European Pat. Off. . |
| 0 695 584 A2 | 2/1996 | European Pat. Off. . |
| 2 207 983 | 8/1973 | Germany . |
| 29 36 754 A1 | 4/1981 | Germany . |
| 31 35 220 A1 | 3/1983 | Germany . |
| 32 17 779 A1 | 11/1983 | Germany . |
| 38 19 203 A1 | 12/1989 | Germany . |
| 38 18 643 C2 | 5/1991 | Germany . |
| 41 10 127 C2 | 2/1993 | Germany . |
| 42 07 118 A1 | 9/1993 | Germany . |
| 44 27 904 A1 | 2/1996 | Germany . |
| 196 32 899 A1 | 2/1998 | Germany . |
| 196 35 830 A1 | 3/1998 | Germany . |
| 951319 | 3/1964 | United Kingdom . |

OTHER PUBLICATIONS

German Utility Model 94 21 763 U1, dated Sep. 26, 1996.

*Primary Examiner*—Laura Edwards
*Attorney, Agent, or Firm*—Herbert L. Lerner; Laurence A. Greenberg; Werner H. Stemer

[57] ABSTRACT

A device for applying powder to sheets passing sequentially through a printing press in a conveying direction along a conveyor route, the sheets being combinable into a sheet pile in a manner that one respective side of upper and rear sides of a respectively following sheet is situated opposite the other respective side of the upper and rear sides of a respectively preceding sheet, includes a device for generating a powder-bearing gas curtain associated with the conveyor route and formed of a carrier gas conveying powder particles, and for applying the powder of said gas curtain to the rear side of the respective sheets prior to the combination of the sheets into the sheet pile.

25 Claims, 6 Drawing Sheets

DEVICE FOR APPLYING POWDER TO SHEETS

BACKGROUND OF THE INVENTION

Field of the Invention

The invention relates to a device for applying powder to sheets passing sequentially through a printing press in a conveying direction along a conveyor route, the sheets being combinable into a sheet pile in a manner that one respective side of the upper and rear sides of a respectively following sheet is situated opposite the other respective side of the upper and rear sides of a respectively preceding sheet, after powder has been applied thereto through the intermediary of a powder-bearing gas curtain associated with the conveyor route and formed of a carrier gas conveying powder particles therewith, and further relates to such a powder-applying device in combination with a delivery of a sheet-processing printing press.

Heretofore known devices for applying powder to sheets have a powder-bearing gas dispensing device, such as a sprayer, which produces a powder-bearing gas curtain directed against the upper side of the sheets. This upper side is the front or recto side in the case of sheets which are printed on only one side thereof. The powder-bearing gas is made-ready in or supplied to the powder-bearing gas dispensing or sprayer device by a powder-bearing gas generator which distributes powder particles in a carrier-gas flow. By applying powder to the sheets, the latter are prevented from being baked together if a coating thereon of printing ink or varnish has not yet hardened completely when the sheets have been laid upon one another on a sheet pile.

In the heretofore known conventional devices, the powder-bearing gas dispensing or spraying device must be arranged at a relatively great distance from the conveyor route of the sheets in order that the grippers moving the sheets can run through unhindered between the sheets and the powder-bearing gas dispensing device. For this reason, the transfer of powder onto the sheets is not always satisfactory.

SUMMARY OF THE INVENTION

It is accordingly an object of the invention to provide a device for applying powder to sheets which transfers the powder onto the sheets more effectively than heretofore known devices of this general type.

With the foregoing and other objects in view, there is provided, in accordance with the invention, a device for applying powder to sheets passing sequentially through a printing press in a conveying direction along a conveyor route, the sheets being combinable into a sheet pile in a manner that one respective side of upper and rear sides of a respectively following sheet is situated opposite the other respective side of the upper and rear sides of a respectively preceding sheet, comprising a device for generating a powder-bearing gas curtain associated with the conveyor route and formed of a carrier gas conveying powder particles, and for applying the powder of the gas curtain to the rear side of the respective sheets prior to the combination of the sheets into the sheet pile.

In accordance with another feature of the invention, the powder-applying device comprises a sheet-guiding device for expelling the powder-bearing gas so as to form the powder-bearing gas curtain, the sheet-guiding device being formed with a sheet-guiding surface following the conveyor route.

In accordance with a further feature of the invention, the sheet-guiding device includes a nozzle strip for expelling the powder-bearing gas.

In accordance with an added feature of the invention, the sheet-guiding surface is formed with a cutout assigned to the nozzle strip for passage therethrough of powder-bearing gas expelled from the nozzle strip.

In accordance with an additional feature of the invention, the powder-applying device includes grid rods received in the cutout, the grid rods being disposed at an inclination to the conveying direction of the sheets. This construction provides the advantages that the sheet-guiding device has a sheet-guiding function even in a region where it ejects the powder-bearing gas, and that the sheets are coated uniformly with powder particles, and that, consequently, no powder-free strips are produced.

In accordance with yet another feature of the invention, the sheet-guiding surface is provided with sliding-air dispensing nozzles for expelling sliding air so as to form an air cushion between the sheet-guiding surface and a respective sheet, and powder-bearing gas dispensing nozzles for expelling the powder-bearing gas. This development permits a particularly efficient production of a sheet-guiding plate forming the sheet-guiding surface of the sheet-guiding device.

In accordance with yet a further feature of the invention, the powder-bearing gas dispensing nozzles are disposed in a region of the sheet-guiding device located upstream with respect to the conveying direction of the sheets. This ensures a particularly effective transfer of powder because, downstream from the powder-bearing gas dispensing nozzles, no further air flows or currents, which would blow powder away again, are directed against the rear sides of the sheets.

In accordance with yet an added feature of the invention, the powder-bearing gas dispensing nozzles, respectively, emit a powder-bearing gas jet cluster oriented substantially in the conveying direction of the sheets.

In accordance with yet an additional feature of the invention, the powder-bearing gas dispensing nozzles are formed in at least one row arranged transversely to the conveying direction of the sheets, and the powder-bearing gas jet clusters, towards the ends of at least one row thereof, are oriented increasingly laterally away from the conveying direction to the outside. This construction is advantageous with regard to effective powdering of the lateral edge regions of the sheets, without requiring that the powder-bearing gas dispensing nozzles be provided up to the edges of the sheet-guiding device.

In accordance with still another feature of the invention, the sliding-air dispensing nozzles and the powder-bearing dispensing nozzles have a similar geometric construction.

In accordance with still a further feature of the invention, the powder-applying device includes a powder-bearing gas nozzle chamber, the powder-bearing gas dispensing nozzles, respectively, being formed by an inclined, sector-shaped base wall widening outwardly from the interior of the powder-bearing gas nozzle chamber, the base wall rising to the sheet-guiding surface. With such a construction, a jet of powder-bearing gas emerging from a respective powder-bearing gas dispensing nozzle fans out as it increasingly approaches the sheet. This is advantageous with regard to effective utilization of the powder entrained by the carrier gas.

In accordance with still an added feature of the invention, the powder-applying device includes a powder-bearing gas tube for supplying powder-bearing gas during operation to the powder-bearing gas dispensing nozzles, the tubes, respectively, having an opening communicating with the powder-bearing gas nozzle chamber, and a baffle element is disposed opposite the respective tube opening. This development is also advantageous with regard to a homogeneous application of powder.

In accordance with still an additional feature of the invention, the sheet-guiding device is formed with rows of alternatingly succeeding powder-bearing gas dispensing openings and suction openings extending transversely to the conveyor direction. Thus, local powder-bearing gas flows or currents are generated which have a component of movement transverse to the conveying direction of the sheets. The gas flows or currents containing residual powder are sucked up again quite early, with the result that only a little unused powder is dispensed into the environment.

In accordance with another feature of the invention, the suction openings are offset upstream with respect to the conveyor direction from the powder-bearing gas dispensing openings. This construction ensures that residual powder is sucked off particularly effectively.

In accordance with a further feature of the invention, the powder-applying device includes respective comblike distributor units with which the powder-bearing gas dispensing openings, on the one hand, and the suction openings, on the other hand, communicate.

In accordance with an added feature of the invention, the sheet-guiding surface is formed with a multiplicity of openings, and the powder-applying device includes a distributor box communicating with the openings, a feed shaft terminating in the distributor box and having therein a sliding-air flow emerging from the openings, and at least one nozzle for dispensing the powder-bearing gas in the form of a powder-bearing gas cone, the at least one nozzle terminating in the feed shaft. With this relatively simple construction, the powder-bearing gas can be added to the sliding air.

In accordance with an additional feature of the invention, the powder-applying device includes at least one fan disposed within the feed shaft for generating the sliding-air flow.

In accordance with yet another feature of the invention, the powder-bearing gas cone and the sliding-air flow intersect.

In accordance with yet a further feature of the invention, the powder-bearing gas cone has an aperture angle ranging between 40° and 80°.

Thus, an intensive mixing of powdering gas and sliding air without any relatively large apparatus is possible.

In accordance with yet an added feature of the invention, the powder-applying device includes a powder-bearing gas trap disposed upstream with respect to the conveyor direction from the powder-bearing gas curtain. This is advantageous with regard to avoiding the escape of residual powder into the environment of the device.

In accordance with yet an additional feature of the invention, the powder-bearing gas trap is formed as a doctor blade arrangement. With this construction, gas containing residual powder is positively disposed of.

In accordance with still another feature of the invention, the powder-bearing gas trap is formed with disposal openings subjected to negative pressure during operation, and with supply openings arranged upstream therefrom with respect to the conveyor direction of the sheets, the supply openings being closely adjacent to the disposal openings and being subjected to excess pressure during operation. With this construction, effective adhesion of powder particles to the sheets is produced even if the rear sides of the sheets are very dry. Assurance is provided that the gas which is disposed of and which contains residual powder can be replaced by a corresponding quantity of powder-free air.

In accordance with still a further feature of the invention, sliding air is mixed with the powder-bearing gas for generating an air cushion between the sheet-guiding surface and a respective sheet. This permits the same air-cushion effect to be achieved with the powder-bearing gas as is achieved with the sliding-air dispensing nozzles of the sheet-guiding device.

In accordance with still an added feature of the invention, the powder-applying device includes an electrode for electrically charging the powder particles.

In accordance with a concomitant feature of the invention, the powder-applying device is combined with a delivery of a sheet-processing printing press.

By virtue of the fact that powder is applied to the rear side of the sheets, the powder-bearing gas can be dispensed closer to the conveyor route or track of the sheets, because the grippers moving the sheets extend only slightly under the rear side of the sheets. The device according to the invention also maintains the separating function of the powder particles in the sheet pile, because all that is important for the separating function is that the powder particles be present on the separating surface between sheets lying upon one another. Whether they are inserted into this separating surface on the top side of a sheet lying therebelow or from the underside of a sheet lying thereabove is only of secondary interest.

If desired, the device according to the invention can also be used together with a conventional powdering device applying powder to the top side of the sheets.

If a powder-bearing gas dispensing nozzle has a transversely inclined base wall or floor, it is easily possible thereby to produce a jet of powder-bearing gas which is oblique to the conveying direction.

Other features which are considered as characteristic for the invention are set forth in the appended claims.

Although the invention is illustrated and described herein as embodied in a device for applying powder to sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

BACKGROUND OF THE INVENTION

DESCRIPTION OF THE PREFERRED EMBODIMENTS

Figure 1:
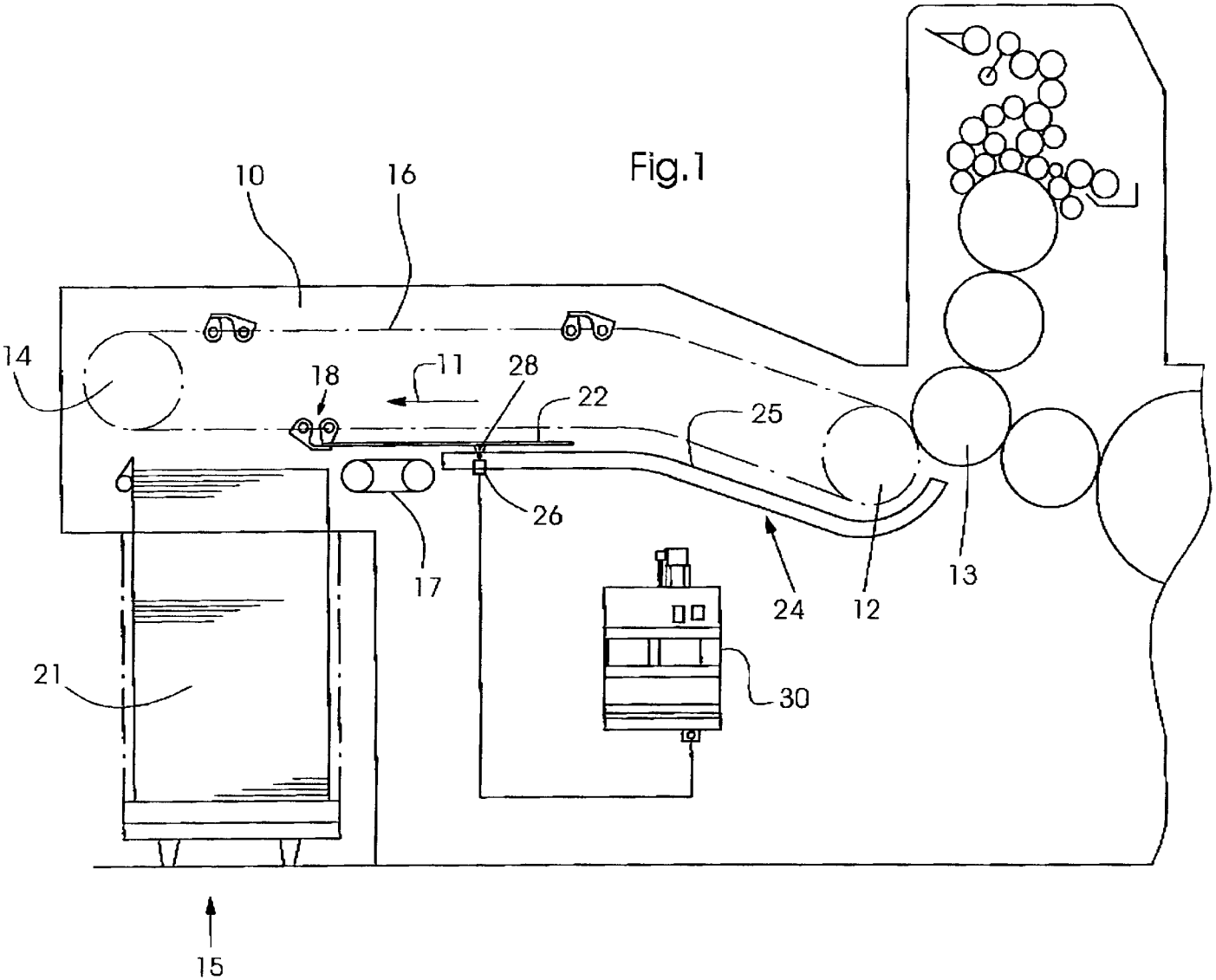
FIG. 1 is a fragmentary diagrammatic side elevational view of a multi-color printing press showing an end section thereof.

Referring now to the drawings and, first, particularly to FIG. 1 thereof, there is shown therein side walls 10 of an end section of a multi-color printing press. Mounted on the side walls 10 are pairs of sprocket wheels 12, 14 which are spaced apart perpendicularly to the plane of the drawing and, respectively, guide a revolving conveyor chain 16. Fitted to the latter at regular spaced distances are very diagrammatically represented gripper units 18 having gripper bars 19 (note FIG. 3) carrying grippers 20 and extending perpendicularly to the plane of FIG. 1 of the drawing, the gripper bars 19 being carried by the conveyor chains 16. As the conveying chains 16 revolve in the direction represented by the arrow 11, the grippers 20 take over the sheets 22 from a last sheet-guiding cylinder 13 of the printing press and convey the sheets 22 along a conveyor route extending essentially up to the sprocket wheels 14 to a sheet stacking station 15, in order to transfer the sheets 22 thereat to a sheet brake 17 which, finally, releases the sheets 22 it has braked to form a sheet pile 21. In this regard, the course of the conveyor route is determined by the course of the lower strands of the conveyor chains 16.

The illustrated section of the conveyor route extending approximately from the cylinder 13 to the sheet brake 17 has a sheet-guiding device 24 assigned thereto and following the course thereof, the sheet-guiding device 24 being formed with a sheet-guiding surface 25. A nozzle strip 26 is integrated into the sheet-guiding device 24 and is formed with a plurality of powder-bearing gas dispensing nozzles, which are not shown in detail in FIG. 1, the nozzles being aligned perpendicularly to the plane of the drawing of FIG. 1 and together producing a powder-bearing gas curtain 28 directed towards the rear side or underside of the sheets 22, thereby providing overall a sheet-guiding device 24 which expels the powder-bearing gas to form the powder-bearing gas curtain 28.

Powder particles with carrier gas guiding the particles are fed to the nozzle strip 26 by a diagrammatically represented powder-bearing gas generator 30 which mixes powder particles, for example, corn particles of small diameter, in a respectively required concentration, with a carrier-gas flow.

In order to apply powder to the rear sides of the sheets in the device shown in FIG. 1, the nozzle strip 26 can be arranged in closer proximity to the conveyor route of the sheets, which runs on or at a slight spacing from the sheet-guiding surface 25 of the sheet-guiding device 24. In contrast, if powder is applied by a nozzle strip to the top or front side of the sheets, the spacing between the top side and the nozzle strip is clearly greater, because the gripper units 18 must move through freely below the nozzle strip.

Because of the relatively small spacing achievable by the device between the nozzle strip 26 and the conveyor route, a very effective transfer of powder onto the rear side of the sheets 22 is achieved. The powder layer applied to the latter then effectively prevents the sheets 22 from baking together in the pile 21 if ink layers, and possibly varnish coatings, applied to the sheets are not yet completely dry.

Because the nozzle strip 26 is integrated into the sheet-guiding device 24, a constant and precise positioning of the rear side of the sheets 22 with respect to the nozzle strip 26, under the dynamic conveying conditions, is produced, which has an advantageous effect upon the uniformity of the powder application.

The sheet-guiding device 24 shown in FIG. 1 cooperates chiefly mechanically with the rear side of the sheets 22, there being a certain air film being formed, however, between the sheets 22 and the sheet-guiding surface 25 because of the speed at which the sheets are conveyed.

Figure 2:
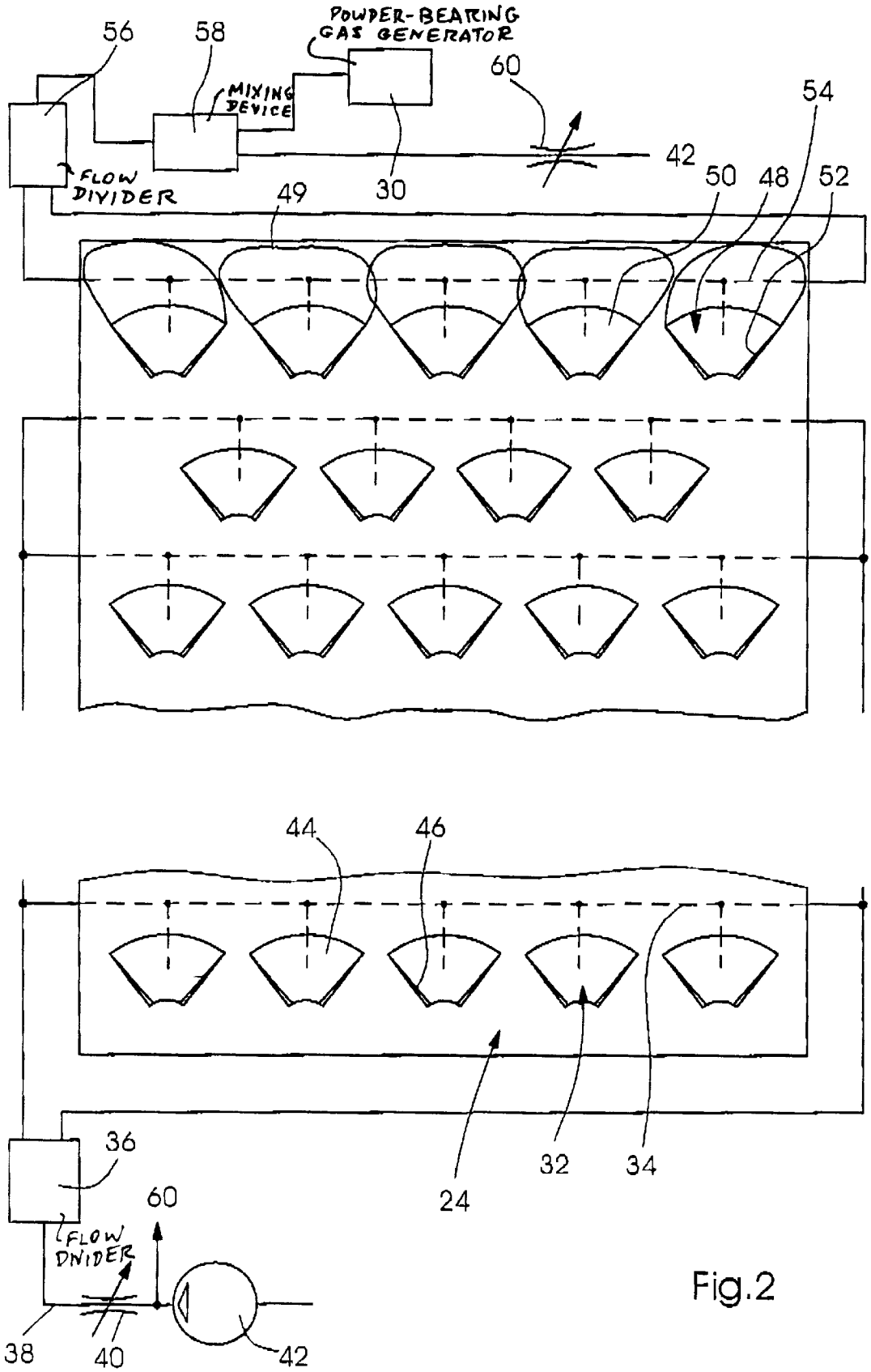
FIG. 2 is a schematic and fragmentary diagrammatic plan view of the press end section of FIG. 1 showing a sheet-guiding device thereof.

In order to achieve reinforced supporting of the sheets 22 in the region of the sheet-guiding device 24 by an air cushion, which is particularly advantageous for sheets which are printed on both sides thereof, the sheet-guiding device 24 is preferably constructed as an air-cushion guiding element, as shown in FIG. 2. Sliding air is blown in between the sheets 22 and the sheet-guiding surface 25 in order to form an air cushion. For this purpose, there are provided a number of sliding-air dispensing nozzles 32 which are arranged in rows and distributed over the sheet-guiding surface 25. The sliding-air dispensing nozzles 32 are respectively connected to a transverse distributor channel 34 having two ends which are connected to a sliding-air feedline 38 via a symmetrical flow divider 36. The sliding-air feedline 38 is connected, in turn, to the outlet of a fan 42 via an adjustable throttle or choke 40. As is apparent from the drawing, the sliding-air dispensing nozzles 32 of rows thereof succeeding one another in the conveying direction are laterally offset with respect to one another by half a division, so that, on average, the sheets 22 are supported uniformly in a transverse direction.

Figure 4:
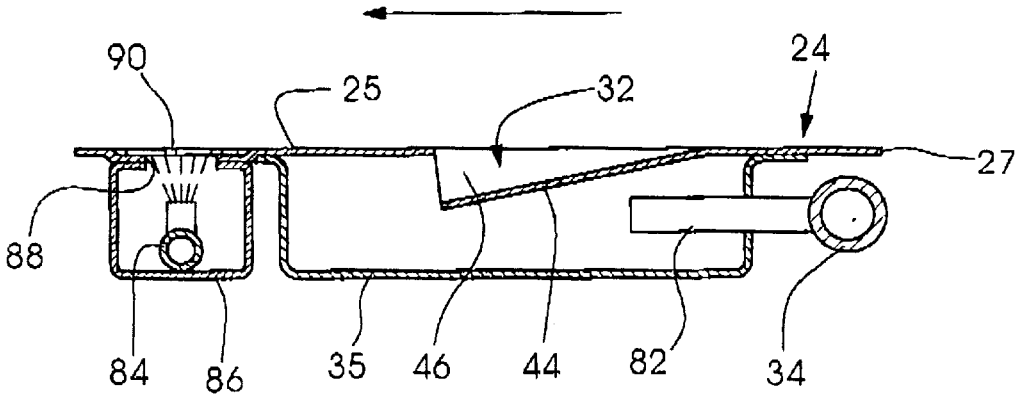
FIG. 4 is a sectional view like that of FIG. 3 showing a sheet-guiding device provided with a different embodiment of the powder-bearing gas dispensing nozzle.

In the plan view according to FIG. 2, the sliding-air dispensing nozzles 32 are shown in the shape of sectors of a circle and, respectively, exhibit an inclined base wall or floor 44 which, while widening from the interior of a sliding-air dispensing chamber 35, rises towards the sheet-guiding surface 25 (note FIG. 4). Accordingly, the sliding-air dispensing nozzles 32 have lateral triangular boundary walls 46.

Provided at the downstream end of the sheet-guiding device 24 shown at the top of FIG. 2 is a row of powder-bearing gas dispensing nozzles 48 extending transversely to the conveying direction of the sheets 22, for clusters of dispensing powder-bearing gas jets 49 which are oriented essentially in the conveying direction of the sheets 22 and, at a respective end of the row of powder-bearing gas dispensing nozzles 48, are inclined laterally outwardly with respect to the conveying direction.

With a respective inclined, sector-shaped base wall 50 and lateral boundary walls 52, the powder-bearing gas dispensing nozzles 48 have a geometry similar to that of the sliding-air dispensing nozzles 32, with the result that a very uniform application of powder can be achieved through the intermediary of widely discharging clusters of powder-bearing gas jets 49. The powder-bearing gas dispensing nozzles 48 are connected to a transverse distributor channel 54 having ends which are connected to the output of a mixing device 58 via a symmetrical flow divider 56. One inlet of the mixing device 58 is connected to an outlet of the powder-bearing gas generator 30, while the other input of the mixing device 58 is connected via an adjustable throttle 60 to an outlet of the fan 42 shown at the bottom of FIG. 2.

In this manner, the powder-bearing gas dispensing nozzles 48 dispense a quantity of powder which is set or adjusted at the powder-bearing gas generator 30 and, simultaneously, a total quantity of air which can be prescribed by adjusting the throttle 60. What is overall accomplished thereby is that, just like the sliding-air dispensing nozzles 32, the powder-bearing gas dispensing nozzles 48 contribute to the formation of the air cushion, powder particles being also applied, however, simultaneously to the rear side of the sheets 22 by the powder-bearing gas dispensing nozzles 48.

Figure 3:
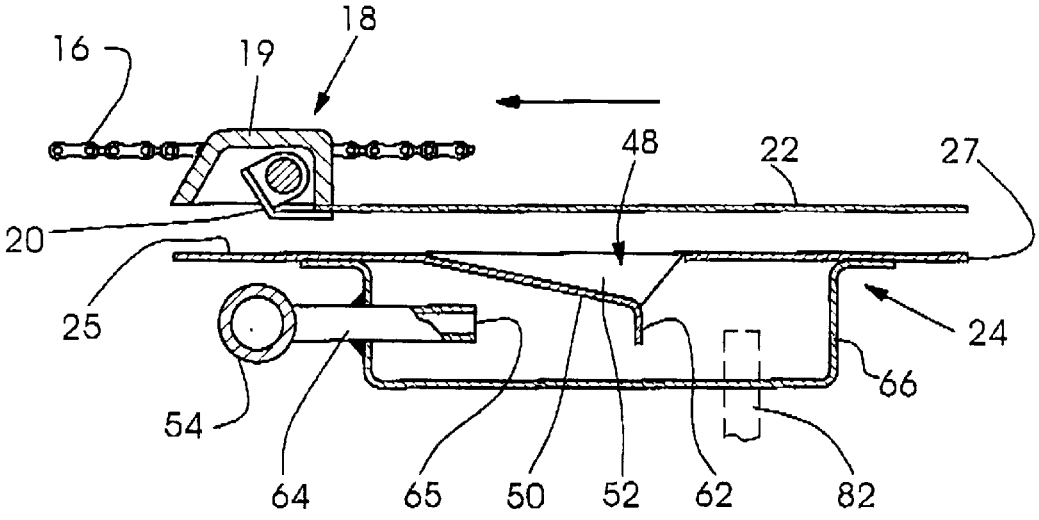
FIG. 3 is a much-enlarged longitudinal sectional view, extending in the sheet-conveying direction, of a powder-bearing gas dispensing nozzle of the sheet-guiding device shown in FIG. 2, together with a gripper unit and part of a sheet conveyed thereby.

As is apparent from FIG. 3, the base wall or floor 50 of the powder-bearing gas dispensing nozzles 48 has a section canted downwardly and constituting a baffle element 62. The canted section 62 is situated opposite an opening 65 formed in a powder-bearing gas tube 64 which leads from the distributor channel 54 into the interior of a powder-bearing gas nozzle chamber 66 surrounding the powder-bearing gas dispensing nozzle 48 and arranged on the underside of a sheet guide plate 27 (in practice, a stainless steel plate) forming the sheet-guiding surface 25. In this manner, the powder-bearing gas is thoroughly mixed once again before emerging from the powder-bearing gas dispensing nozzle 48, and the powder-bearing gas jet emerging from the opening 65 of the powder-bearing gas tube 64 is fanned out. Only after the powder-bearing gas traverses a U-shaped deflecting path which passes below the end of the baffle element 62 and is then guided in a direction counter to the wall of the powder-bearing gas nozzle chamber 66 located at the right-hand side of FIG. 3, does the powder-bearing gas then emerge from the powder-bearing gas dispensing nozzle 48 along the rising base wall or floor 50. By transversely tilting the base wall or floor 50 additionally with respect to the conveying direction, a powder-bearing gas jet cluster 49 emerging from the powder-bearing gas dispensing nozzle 48 can present an orientation which is inclined to the conveying direction. Also apparent from FIG. 3 is the mutual assignment of the sheet-guiding device 24 provided with the powder-bearing gas dispensing nozzles 48, and a sheet 22 guided away thereover by the gripper unit 18.

In a modified construction of the aforedescribed exemplary embodiment, the powder-bearing gas dispensing nozzles 48 are preferably additionally supplied with sliding air. As indicated by broken lines in FIG. 3, a sliding-air dispensing tube 82 opening into the powder-bearing gas nozzle chamber 66 can be provided for this purpose.

Figure 5:
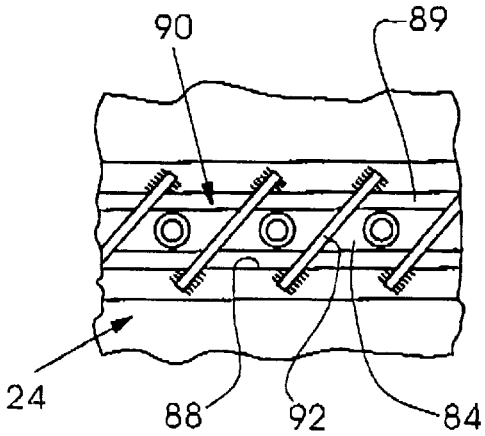
FIG. 5 is a fragmentary top plan view of FIG. 4, rotated clockwise through an angle of 90°.

In another modified exemplary embodiment, powder-bearing gas can also be applied to the rear side of the sheets 22 by a transversely arranged nozzle strip 84 which, as shown in FIG. 4, is surrounded by a shaft or compartment 86 which is formed with an outlet opening 88 directed towards the rear side of the sheets 22 and extending over the width of the printed sheet 22. The outlet opening 88 is covered by a grating or grid 90, which is recessed into a corresponding cutout 89 incised into the sheet guide plate 27, and is formed of a plurality or multiplicity of grating or grid bars 92 inclined to the conveying direction of the printed sheets 22, as is apparent from FIG. 5. The ends of the grating or grid bars 92 overlap precisely in the direction perpendicular to the conveying direction of the sheets 22 and, in this manner, represent a mechanical continuation of the sheet-guiding surface 25 in the region of the outlet opening 88, while at the same time, however, permitting powder to be applied homogeneously to the rear side of the sheets 22.

In the exemplary embodiment shown in FIG. 4, the row of sliding-air dispensing nozzles 32 directly adjacent the nozzle strip 84 upstream is aligned in an opposite manner, as represented in FIG. 2. Therewith, a sliding-air flow is produced which is locally opposite to the conveying direction of the sheets 22. In this manner, an intensified air-cushion effect is provided locally by stagnation of the sliding air dispensed from the sliding-air dispensing nozzles 32, which are located farther upstream and aligned in the conveying direction, so that the sliding-air current is kept away at least partly from the outlet opening 88 through which powder-bearing gas flows, and the powder-bearing gas effectively reaches the rear side of the sheets 22.

Figure 6:
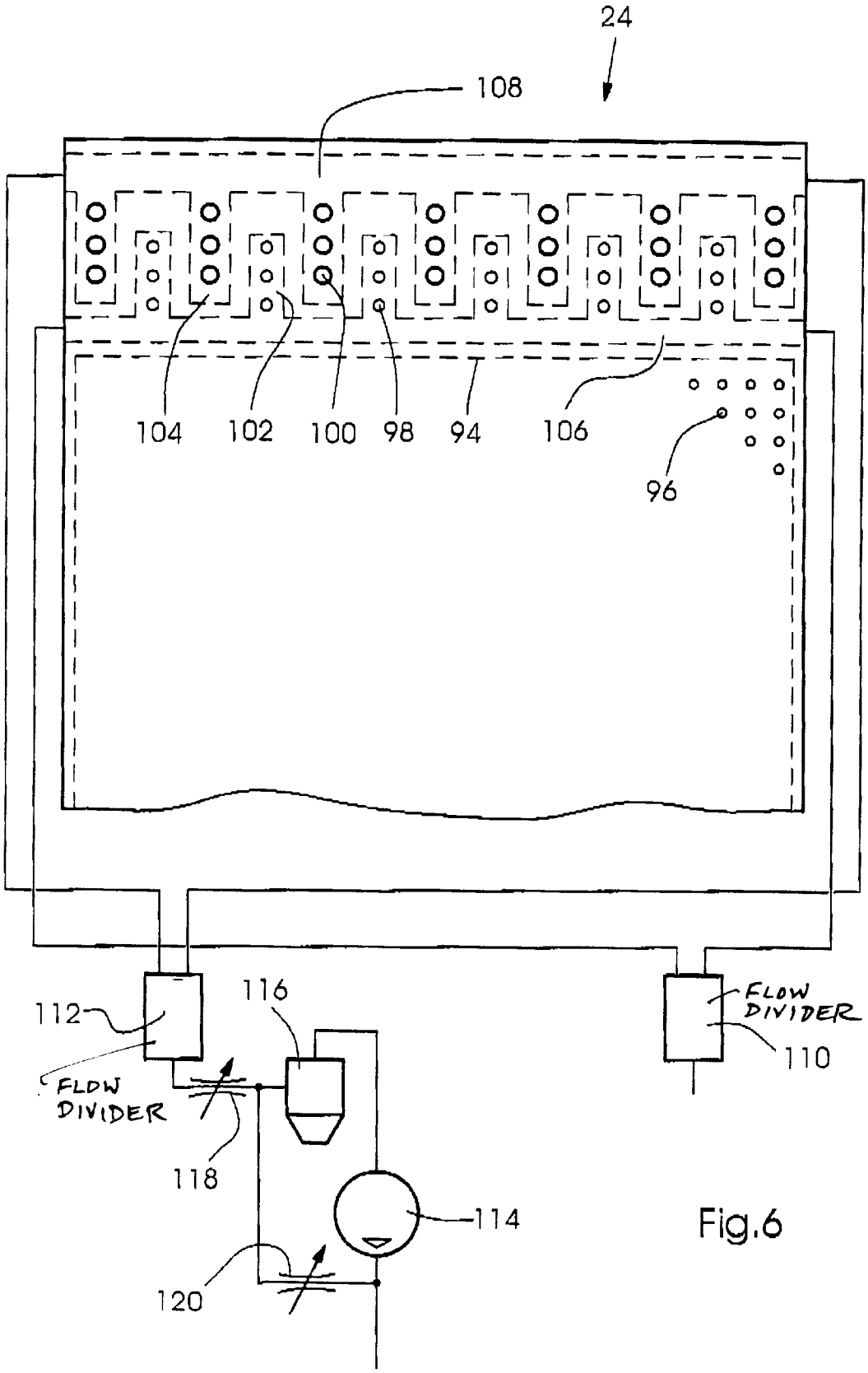
FIG. 6 is a reduced fragmentary schematic and diagrammatic top plan view of FIG. 4 showing a different embodiment of the sheet-guiding device.

In the exemplary embodiment shown in FIG. 6, a sliding-air box 94 is arranged on the underside of a sheet guide plate 27 forming the sheet-guiding surface 25, and regularly or orderly distributed sliding-air openings 96 are formed in the sheet guide plate 27 within the edge or border contour of the sliding-air box 94.

Provided in an upstream section of the sheet-sliding device 24 are powder-bearing gas dispensing openings 98 and suction openings 100 which alternatingly succeed one another in the transverse direction. The powder-bearing gas dispensing openings 98, on the one hand, and the suction openings 100, on the other hand, are respectively connected to comb-like distributor units 106 and 108, respectively, having respective transversely arranged comb backs, the powder-bearing gas dispensing openings 98 and the suction openings 100, respectively, being arranged on comb teeth 102 and 104, respectively, of which the teeth of one of the comb-like distributor units 106, 108 engage in the gaps between the teeth of the other of the comb-like distributor units 108, 106. The lateral ends of the comb backs, respectively, are connected via symmetrical flow dividers 110 and 112 to the powder-bearing gas generator 30 and the suction side of a fan 114, respectively.

As is apparent from FIG. 6, the suction openings 100 and the powder-bearing gas dispensing openings 98 are arranged in a plurality of rows (three rows in FIG. 6) succeeding one another in the conveying direction and being perpendicular thereto. The suction openings 100, however, are offset overall by one division downstream with respect to the powder-bearing gas dispensing openings 98, so that the local flows from the powder-bearing gas dispensing openings 98 to the suction openings 100 have a component aligned parallel to the conveying direction of the sheets 22 in addition to a predominantly transverse component.

In the exemplary embodiment shown in FIG. 6, residual powder which has not been deposited on the sheets 22 is already largely taken care of again in the region of the sheet-guiding device 24 and not carried into the neighboring regions of the printing press. The residual powder is separated in a cyclone 116 connected to the suction side of the fan 114. In this regard, the intensity of the suction flow through the suction openings 100 is adjusted by an adjustable throttle 118 connected upstream of the inlet to the cyclone 116. In order to ensure satisfactory operation of the cyclone 116 independently of the intensity of this suction flow, a basic air flow or current is maintained through the cyclone 116 by a connection, including a further adjustable throttle 120, provided between the outlet side of the fan 114 and the cyclone 116.

Figure 7:
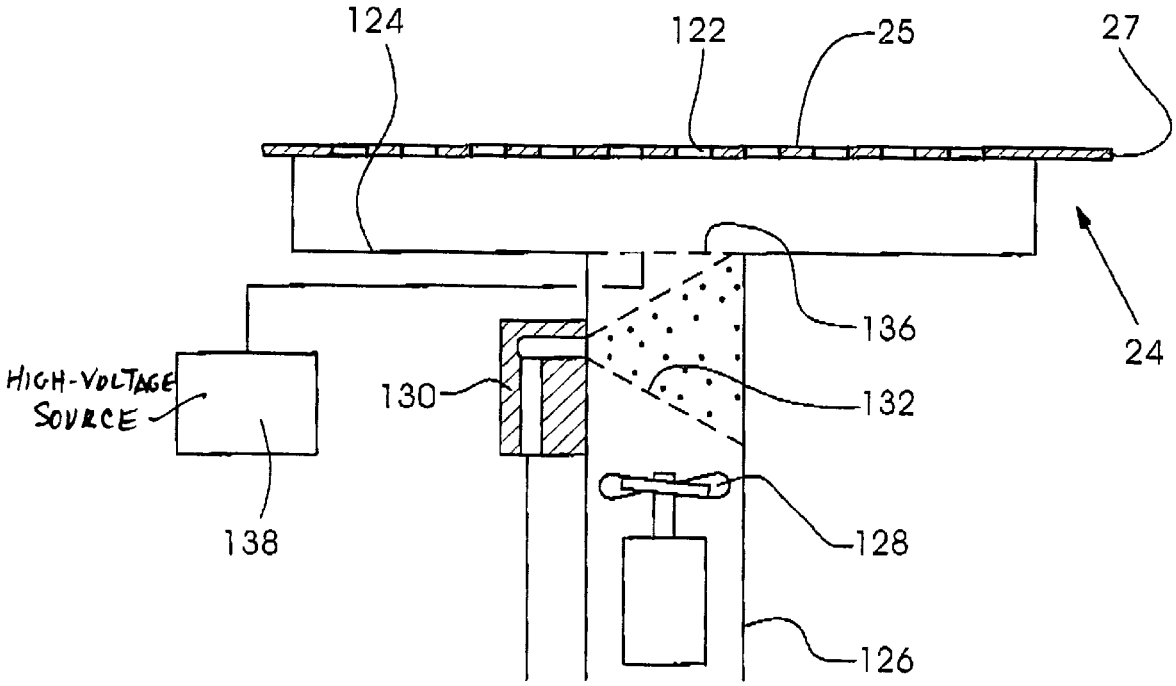
FIG. 7 is a view similar to that of FIG. 4 showing schematically and diagrammatically the sheet-guiding device with yet a different powder-bearing gas dispensing nozzle.

In the exemplary embodiment according to FIG. 7, the sheet-guiding device 24 has a multiplicity of openings 122 which simultaneously serve to produce an air cushion and apply powder to the rear side of the sheets 22. The openings 122 communicate with a distributor box 124 which is connected to a feed shaft 126. In the feed shaft 126, perpendicularly to the plane of the drawing, a plurality of fans 128 are arranged one after another for supplying a sliding-air flow, which emerges from the openings 122, so as to produce an air cushion between the sheet-guiding surface 25 and a respective one of the sheets 22. Downstream opposite a respective fan 128, there is assigned thereto a respective nozzle 130 which dispenses into the supply shaft 126 a powder-bearing gas cone 132 intersecting the sliding-air flow. The powder-bearing gas cone 132 has an aperture angle which, in practice, is between 40° and 80°, and preferably approximately 60°. The nozzles 130 are connected to the outlet of the powder-bearing gas generator 30.

In order to promote the transfer of the powder-bearing gas onto the rear sides of the printed sheets 22, there is fitted on the feed shaft 126 at the end thereof facing the distributor box 124, via conventional insulating elements, which are not shown in detail in the drawing, a net-shaped electrode 136 which is connected to a high-voltage source 138 and charges the powder particles electrically so that the latter adhere effectively to the rear side of the sheets 22 upon impinging thereon.

Figure 8:
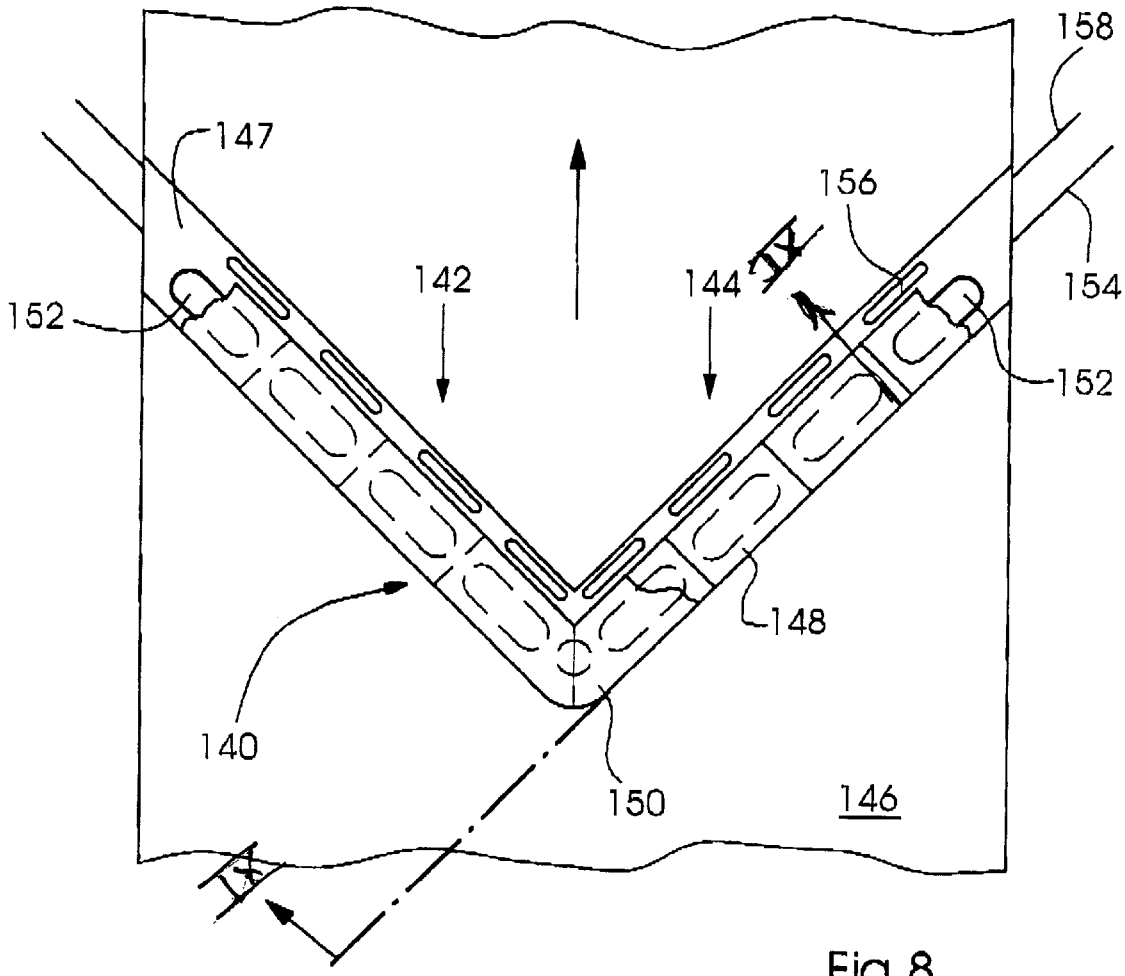
FIG. 8 is a fragmentary bottom plan view of a powder-bearing gas trap forming part of the invention.
Figure 9:
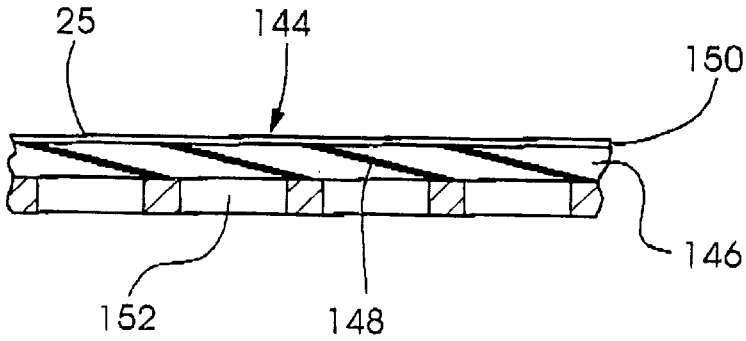
FIG. 9 is a sectional view of FIG. 8 taken along the line IX—IX in the direction of the arrows.

FIGS. 8 and 9 show a powder-bearing gas trap 140 in the form of a doctor blade arrangement by which powder-bearing gas containing residual powder can be sucked off in a region of the sheet-guiding device 24 located downstream with respect to the powder-bearing gas curtain 28.

The doctor blade arrangement has two blade arms 142 and 144 which together form a V which opens in the conveying direction of the sheets 22 represented by the vertical arrow in the middle of FIG. 8. In sections located upstream on the doctor blade arms 142 and 144, the latter, respectively, have thin guide plates 148 respectively extending upwards obliquely to a baseplate 146. The guide plates 148 are inserted into a V-shaped cutout formed in the baseplate 146 and are connected at upper ends thereof by a thin baseplate 150 which is flush with the sheet-guiding surface 25. Situated below the guide plates 148, respectively, are disposal openings 152 which are connected via manifolds 154 to the suction side of a fan (not shown in FIG. 8).

In a downstream section of the doctor arms 142 and 144, supply openings 156 for powder-free air are formed. The openings 156 are connected via feed lines 158 to a fan (not shown in FIG. 8) which supplies fresh air, although in practice it can be formed by the fan 42 of FIG. 2.

The supply openings 156 are formed so that fresh-air jets emerging therefrom enclose with the plane of the baseplate 146 an angle of, for example, 60°, with the result that, on the one hand, an overall essentially constant support of the sheets by air cushion is attained in the region of the doctor arms 142 and 144, however, on the other hand, the supplied fresh air is already dispensed with a velocity component extending parallel to the conveying direction of the sheet.

Due to the fact that the exchange of air, because of the V-shaped geometry of the doctor blade arrangement, does not take place abruptly, but rather, over a region along the conveyor route of the sheets, abrupt mechanical loadings on the sheets 22 are avoided.

It is noted that the doctor blade arrangement shown in FIGS. 8 and 9, on the one hand, does not act directly mechanically on the sheets, because of air-cushion effects, while, on the other hand, it replaces gas containing residual powder with fresh air. Due to the manner of construction of the supply openings 156, however, the fresh air does not act strongly upon the rear side of the sheets 22, as a result of which, powder particles adhering thereto could be detached again.

I claim:

1. A device for applying powder to sheets, the sheets having respective upper and lower sides and passing sequentially along a route of a conveyor in a printing press to form a sheet pile, the device comprising:

a sheet guiding device for generating a powder-bearing gas and for applying the powder of the gas to the lower sides of the sheets prior to the formation of the sheet pile, said sheet-guiding device formed with a sheet-guiding-surface following the route of the conveyor.

2. The powder-applying device according to claim 1, wherein said sheet-guiding device includes a nozzle strip for expelling the powder-bearing gas.

3. The powder-applying device according to claim 2, wherein said sheet-guiding surface is formed with a cutout assigned to said nozzle strip for passage therethrough of powder-bearing gas expelled from said nozzle strip.

4. The powder-applying device according to claim 3, including grid rods received in said cutout, said grid rods being disposed at an inclination to the conveying direction of the sheets.

5. The powder-applying device according to claim 1, wherein said sheet-guiding surface is provided with sliding-air dispensing nozzles for expelling sliding air so as to form an air cushion between the sheet-guiding surface and a respective sheet, and powder-bearing gas dispensing nozzles for expelling the powder-bearing gas.

6. The powder-applying device according to claim 5, wherein said powder-bearing gas dispensing nozzles are disposed in a region of said sheet-guiding device located upstream with respect to the conveying direction of the sheets.

7. The powder-applying device according to claim 5, wherein said powder-bearing gas dispensing nozzles, respectively, emit a powder-bearing gas jet cluster oriented substantially in the conveying direction of the sheets.

8. The powder-applying device according to claim 7, wherein said powder-bearing gas dispensing nozzles are formed in at least one row arranged transversely to the conveying direction of the sheets, and said powder-bearing gas jet clusters, towards the ends of at least one row thereof, are oriented increasingly laterally away from the conveying direction to the outside.

9. The powder-applying device according to claim 5, wherein said sliding-air dispensing nozzles and said powder-bearing dispensing nozzles have a similar geometric construction.

10. The powder-applying device according to claim 5, including a powder-bearing gas nozzle chamber, said powder-bearing gas dispensing nozzles, respectively, being formed by an inclined, sector-shaped base wall widening outwardly from the interior of said powder-bearing gas nozzle chamber, said base wall rising to said sheet-guiding surface.

11. The powder-applying device according to claim 10, including a powder-bearing gas tube for supplying powder-bearing gas during operation to said powder-bearing gas dispensing nozzles, said tubes, respectively, having an opening communicating with said powder-bearing gas nozzle chamber, and including a baffle element disposed opposite the respective tube opening.

12. The powder-applying device according to claim 1, wherein said sheet-guiding device is formed with rows of alternatingly succeeding powder-bearing gas dispensing openings and suction openings extending transversely to the conveyor direction.

13. The powder-applying device according to claim 12, wherein said suction openings are offset upstream with respect to the conveyor direction from said powder-bearing gas dispensing openings.

14. The powder-applying device according to claim 12, wherein said sheet-guiding device includes a first comb-shaped distributor unit communicating with said powder-bearing gas dispensing openings, and a second comb-shaped distributor unit communicating with said suction openings.

15. The powder-applying device according to claim 1, wherein said sheet-guiding surface is formed with a multiplicity of openings, and including a distributor box communicating with said openings, a feed shaft terminating in said distributor box, said feed shaft having therein a sliding-air flow emerging from said openings, and at least one nozzle for dispensing the powder-bearing gas in the form of a powder-bearing gas cone, said at least one nozzle terminating in said feed shaft.

16. The powder-applying device according to claim 15, including at least one fan disposed within said feed shaft for generating said sliding-air flow.

17. The powder-applying device according to claim 15, wherein said powder-bearing gas cone and said sliding-air flow intersect.

18. The powder-applying device according to claim 15, wherein said powder-bearing gas cone has an aperture angle ranging between 40° and 80°.

19. The powder-applying device according to claim 1, including a powder-bearing gas trap disposed upstream with respect to the conveyor direction from said powder-bearing gas curtain.

20. The powder-applying device according to claim 19, wherein said powder-bearing gas trap is formed as a doctor blade arrangement.

21. The powder-applying device according to claim 19, wherein said powder-bearing gas trap is formed with disposal openings subjected to negative pressure during operation, and with supply openings arranged upstream therefrom with respect to the conveyor direction of the sheets, said supply openings being closely adjacent to said disposal openings and being subjected to excess pressure during operation.

22. The powder-applying device according to claim 1, wherein sliding air is mixed with said powder-bearing gas for generating an air cushion between said sheet-guiding surface and a respective sheet.

23. The powder-applying device according to claim 1, including an electrode for electrically charging the powder particles.

24. In combination with a delivery of a sheet-processing printing press having a conveyor extending along a route, a device for applying powder to sheets, the sheets having respective upper and lower sides and passing sequentially along the route of said conveyor of said delivery to form a sheet pile, the device comprising:

a sheet guiding device for generating a powder-bearing gas and for applying the powder of the gas to the lower sides of the sheets prior to the formation of the sheet pile, said sheet-guiding device formed with a sheet-guiding surface following the route of said conveyor.

25. A device for applying powder to sheets, the sheets having respective upper and lower sides and passing sequentially along a route of a conveyor in a printing press to form a sheet pile, the device comprising:

a sheet-guiding surface following the route of the conveyor; and a nozzle for receiving a powder-bearing gas and for applying the powder of the gas to the lower sides of the sheets prior to the formation of the sheet pile, said nozzle attached to said sheet-guiding surface.

* * * * *